US006899086B2

(12) United States Patent
Grant

(10) Patent No.: US 6,899,086 B2
(45) Date of Patent: May 31, 2005

(54) FUEL PRESSURE ACCUMULATOR WITH FILTER AND REPOSITIONABLE FUEL DELIVERY RING

(76) Inventor: Barry S. Grant, Route 1, Box 1900, Dahlonega, GA (US) 30533

( * ) Notice: Subject to any disclaimer, the term of this patent is extended or adjusted under 35 U.S.C. 154(b) by 0 days.

(21) Appl. No.: 10/659,113

(22) Filed: Sep. 10, 2003

(65) Prior Publication Data

US 2004/0084027 A1 May 6, 2004

Related U.S. Application Data

(60) Provisional application No. 60/409,807, filed on Sep. 10, 2002.

(51) Int. Cl.[7] ..... F02M 37/04

(52) U.S. Cl. ..... 123/447; 123/510

(58) Field of Search ..... 123/447, 467, 123/456, 510; 138/30; 251/54; 137/550

(56) References Cited

U.S. PATENT DOCUMENTS

| | | | | |
|---|---|---|---|---|
| 3,612,105 A | | 10/1971 | Martin | 138/30 |
| 3,621,882 A | | 11/1971 | Kuplec | 138/30 |
| 4,151,823 A | * | 5/1979 | Grosse et al. | 123/196 A |
| 4,388,053 A | * | 6/1983 | Bartel et al. | 417/542 |
| 4,700,668 A | * | 10/1987 | Schierling et al. | 123/73 C |
| 5,160,427 A | * | 11/1992 | Barnette | 210/95 |
| 5,163,468 A | * | 11/1992 | Robinson et al. | 137/315.05 |
| 5,471,959 A | * | 12/1995 | Sturman | 123/447 |
| 5,735,313 A | | 4/1998 | Jenski, Jr. et al. | 138/30 |
| 6,029,708 A | * | 2/2000 | Spell et al. | 138/30 |
| 6,079,450 A | * | 6/2000 | Onishi et al. | 138/30 |
| 6,382,245 B1 | * | 5/2002 | Ito | 137/550 |
| 6,651,627 B2 | * | 11/2003 | Zdroik et al. | 123/456 |

* cited by examiner

*Primary Examiner*—Carl S. Miller
(74) *Attorney, Agent, or Firm*—Thomas, Kayden, Horstemeyer & Risley, LLP

(57) ABSTRACT

Fuel accumulator (10) includes a segmented housing (12) that includes a front wall (34), rear wall (36), and a fuel delivery ring (38). The fuel outlet ports (40) and (42) are formed in the fuel delivery ring, and the fuel delivery ring can be detached, rotated and reattached at different angles about the housing. Flexible diaphragm (72) and the air behind it in the rear wall interior cavity (50) modulate the pressure of the fuel inside the fuel accumulation chamber (60), (70), as the fuel passes through the filter (76).

18 Claims, 2 Drawing Sheets

FUEL PRESSURE ACCUMULATOR WITH FILTER AND REPOSITIONABLE FUEL DELIVERY RING

CROSS REFERENCE

Applicant claims the benefit of Provisional Patent Application No. 60/409,807, filed Sep. 10, 2002.

FIELD OF THE INVENTION

This invention involves a fuel pressure accumulator for use between the outlet of a fuel pump and the internal combustion engine of a self-propelled vehicle, particularly for high performance vehicles, to dampen the high and low pressure pulses in the fuel.

BACKGROUND OF THE INVENTION

During the operation of an internal combustion engine that performs under varying loads, speeds, pressures and performance requirements, it is desirable to maintain a substantially constant fuel pressure feeding to the fuel injectors and carburetors for the engine. Typically, the source of fuel leading to the engine provides some pulses in its pressure because of the various other operations in the system, such as the opening and closing of valves, the changes in demand on the engine, etc.

In order to accommodate the various unpredictable changes in fuel pressure, it is desirable to use a fuel pressure accumulator in the fuel line between the fuel pump and the engine. The typical fuel pressure accumulator includes a chamber that is partitioned with a flexible diaphragm. An air chamber is maintained on one side of the diaphragm and a fuel pressure accumulation chamber is formed on the other side of the diaphragm. Fuel is fed into and exhausted from the fuel pressure accumulation chamber. When there is a pulse in the pressure of the fuel feeding into or leaving the fuel pressure accumulation chamber, the air pressure on the remote side of the diaphragm responds, either by flexing away from the higher, oncoming fuel pressure, or flexing toward the drop in fuel pressure, with the air pressure behind the diaphragm and the resiliency of the diaphragm accommodating the changes in fuel pressure. This dampens the pulses in pressure of the fuel leading to the carburetor or fuel injectors. The end result is that fuel is fed to the engine with a more uniform, predictable fuel pressure.

While the prior art fuel pressure accumulators have functioned as described above, there is a need for a filter to be combined with the accumulator and a means to visually inspect the filter without having to disassemble the accumulator. There is also a need to provide a fuel pressure accumulator that includes an outlet port that can deliver fuel from a plurality of positions about the accumulator so that the engineer/mechanic can direct the fuel in the most desirable direction toward the carburetor or fuel injectors, or to direct the fuel away from an obstruction in the engine compartment. It is to these features that this invention is directed.

SUMMARY OF THE INVENTION

Briefly described, the present invention comprises an improvement over the prior art fuel pressure accumulators. An embodiment of the invention includes an accumulator having a segmented body with a fuel delivery ring between the front wall and the rear wall, with the fuel delivery ring having one or more fuel outlet ports. An adjustable connection between the fuel delivery ring and the front wall of the accumulator allows the fuel delivery ring and its fuel outlet port to be detached, rotated, and re-attached to assume different angular positions about the fuel pressure accumulator. This permits the engineer/mechanic involved with the engine compartment to connect the fuel delivery port in the direction desired, usually toward the carburetor or fuel injectors, without requiring the conduit to extend from a remote position about the fuel pressure accumulator, thus making the installation and maintenance procedures more convenient and expedient for the installer.

Another embodyment of the invention is a fuel delivery ring that has two or more fuel delivery ports for connection to fuel delivery lines leading to the fuel injectors of carburetors.

Another embodiment combines the first two mentioned embodiments so as to provide better versatility of connection of the fuel conduits to the fuel pressure accumulator.

In addition, a fuel filter is placed in the fuel accumulation chamber, between the fuel inlet port of the front wall and the fuel outlet ports of the fuel delivery ring. The fuel filter spans the fuel accumulation chamber, between the fuel delivery ring and the front wall of the segmented housing, and a sight glass is incorporated in the body of the fuel accumulator so as to enable the mechanic to view the dirty side of the filter in the fuel accumulation chamber.

Thus, it is an object of this invention to provide an improved fuel pressure accumulator for an internal combustion engine that includes a repositionable fuel delivery ring for convenience in placing its fuel delivery port at a desired attitude within the engine compartment of the vehicle.

Another object of this invention is to provide an improved fuel pressure accumulator that includes a removable and replaceable filter, with a sight glass that enables the mechanic to view the accumulation of dirt, etc. on the dirty side of the filter in the fuel accumulation chamber.

Other objects, features and advantages of the present invention will become apparent upon reading the following specification, when taken in conjunction with the accompanying drawings.

DETAILED DESCRIPTION

Figure 1:
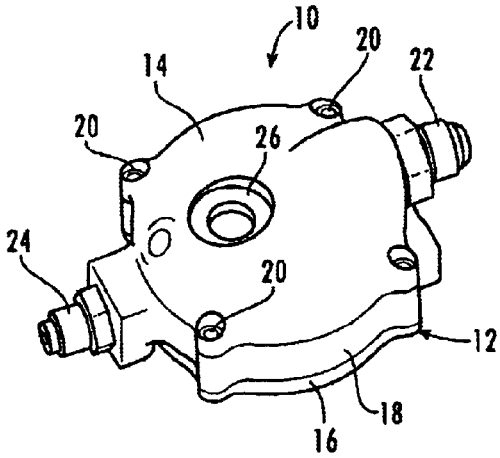
FIG. 1 is a perspective view of the exterior of the fuel accumulator, with this embodiment having one outlet port.

Referring now in more detail to the drawings, in which like numerals indicate like parts throughout the several views, FIG. 1 illustrates the fuel accumulator with a single outlet port 10, that includes a segmented housing 12 having a front wall 14, a rear wall 16 and a fuel delivery ring 18, with the segments 14, 16 and 18 of the housing being held together at their perimeter by perimeter bolts 20. A fuel inlet fitting 22 communicates through front wall 14 with the segmented housing, and fuel outlet fitting 24 communicates through the fuel delivery ring 18 with the segmented housing. A sight glass 26 is received in an opening of the front wall 14.

Figure 2:
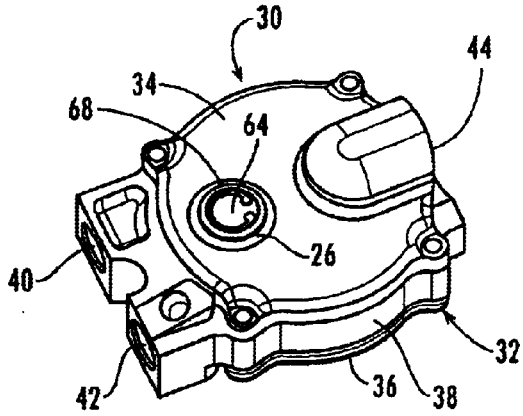
FIG. 2 is a perspective view of a fuel accumulator, similar to FIG. 1, but having two outlet ports.

FIG. 2 shows a similar fuel accumulator that has a similar segmented housing but includes two delivery ports. The segmented housing 32 includes a front wall 34 and a rear wall 36 that are substantially identical to the front and rear walls of FIG. 1, and a fuel delivery ring 38 that includes two fuel delivery ports 42. A single fuel inlet port 44 provides the fuel that passes through the fuel accumulator.

Because of the similarity of the embodiments of FIGS. 1 and 2, FIGS. 3 and 4 illustrate the fuel accumulator 30 that has two delivery ports.

Figure 3:
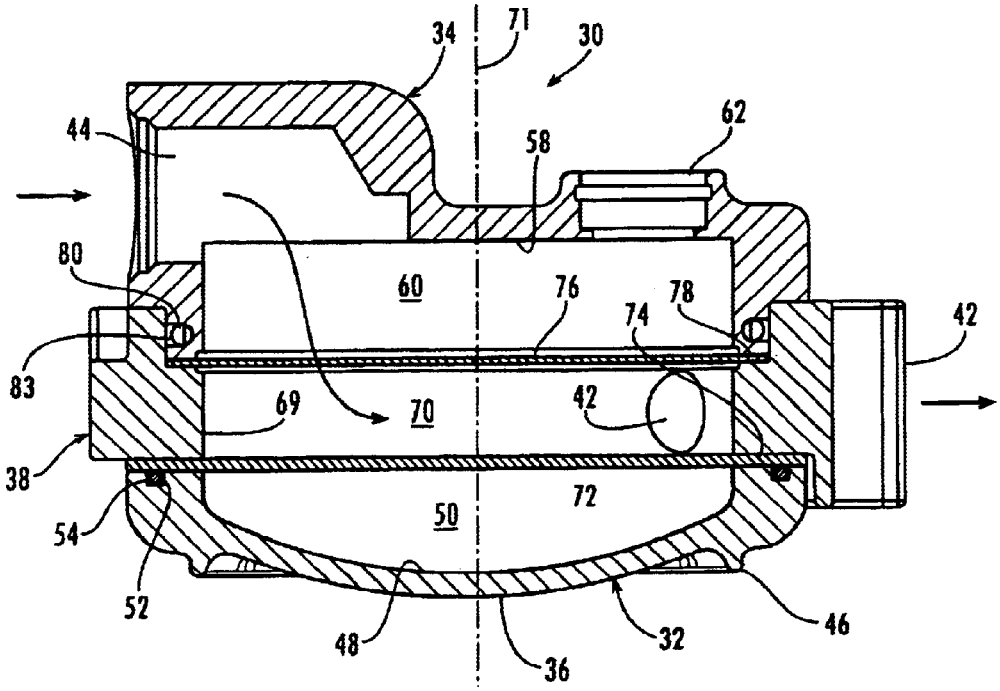
FIG. 3 is a cross-sectional view of the two outlet port fuel accumulator.

As illustrated in FIG. 3, rear wall 36 is dome-shaped, includes a reinforcing ring 46, and defines a concave interior wall 48 that forms a rear wall interior cavity 50. The rear wall 36 is substantially circular and includes a circular O-ring groove 52 that accommodates an O-ring 54.

Front wall 34 has an interior wall surface 58 that defines a front wall interior cavity 60 that faces and is aligned with the rear wall interior cavity 50. Inlet port 44 communicates with front wall interior cavity 60.

Figure 4:
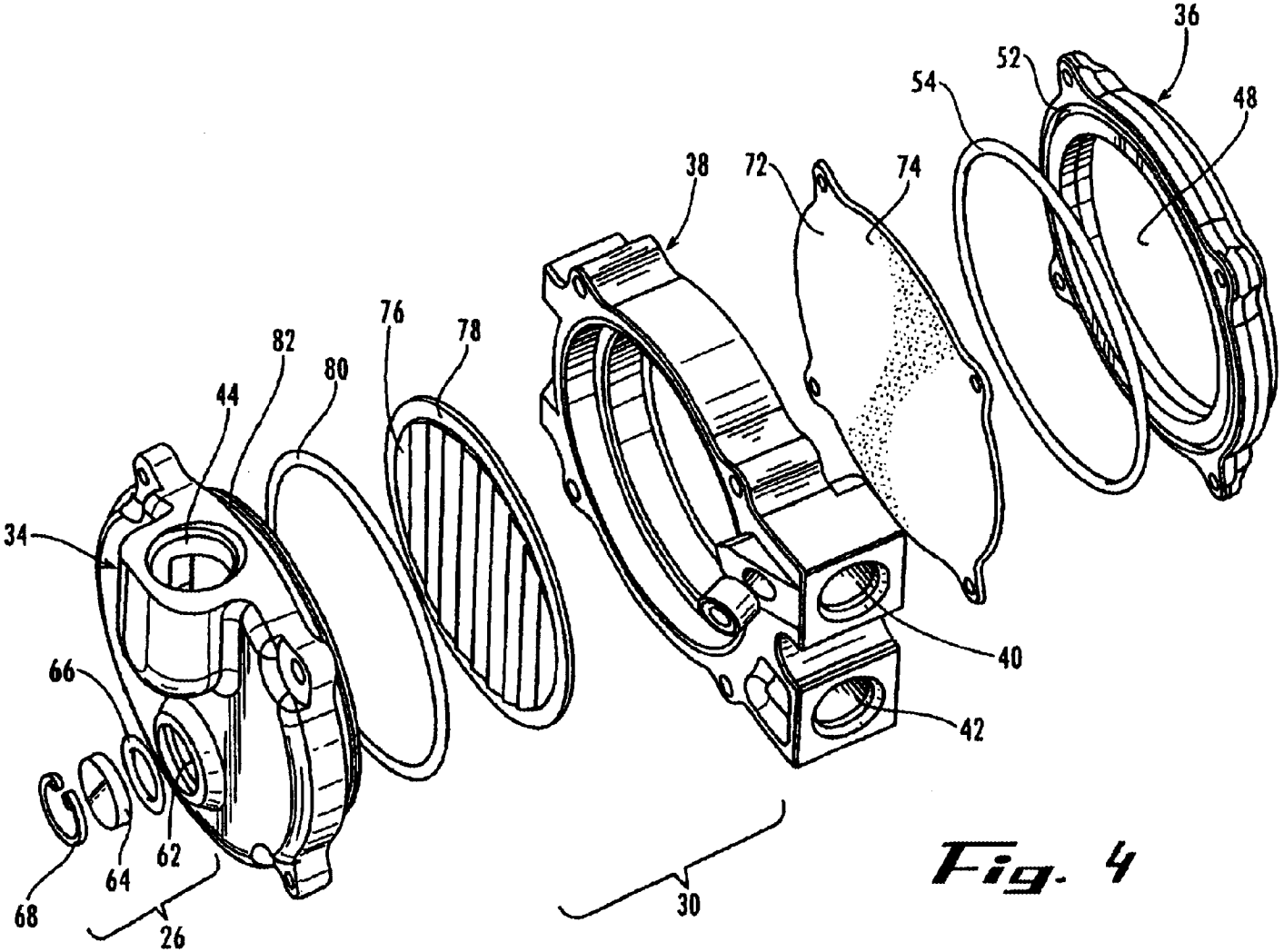
FIG. 4 is an expanded perspective illustration of the two outlet port fuel accumulator.

Sight glass opening 62 is formed in front wall 34, displaced from inlet port 44, and is aligned with front wall interior cavity 60. As shown in FIG. 4, the sight glass lens 64 is mounted in the sight glass opening 62 with an O-ring 66 and a snap ring 68.

Fuel delivery ring 38 includes an interior circular inwardly facing wall surface 69 that defines a circular chamber 70.

Circular chamber 70 is aligned with the rear wall interior cavity 50 and the front wall interior cavity 60, with the interior cavities 50 and 60 and the circular chamber aligned with the longitudinal centerline 71 of segmented housing 12.

Flexible diaphragm 72 has its perimeter 74 clamped between rear wall 36 and fuel delivery ring 38, with the O-ring seal 54 sealed between the rear wall and the flexible diaphragm.

Fuel filter 76 is positioned with its perimeter 78 clamped between the fuel delivery ring 38 and front wall 34, with an O-ring seal 80 positioned in the O-ring groove 82 of the front wall 34, sealing the front wall to the fuel delivery ring 38.

With this arrangement, fuel enters the fuel inlet port 44 of the segmented housing 12 and passes through the front wall interior cavity 60, then through the fuel filter 76 and into circular chamber 70 of the fuel delivery ring 38, and then out of the delivery ports 40 and 42 of the fuel delivery ring 38. The filter 76 blocks the movement of any trash, etc. carried with the fuel, keeping the trash from passing on to the engine. Thus, the front wall interior cavity 60 and the circular chamber 70 function as a fuel accumulation chamber, with the front wall interior cavity 60 functioning as an unfiltered fuel accumulation chamber and the circular chamber 70 of the fuel delivery ring functioning as a filtered fuel accumulation chamber.

In the meantime, when a change in pressure, in the form of a pressure pulse, occurs in the fuel accumulation chamber 60, 70, the flexible diaphragm 72 will move in response thereto. If the pressure suddenly increases, the flexible diaphragm will move toward the rear wall interior cavity 50, which increases the pressure of the air or other gas in the rear wall interior cavity 50, thus increasing the resistance that the gas applies to the inwardly moving flexible diaphragm 72. This offer more resistance to the increase in pressure of the fuel.

Likewise, should the pressure of the fuel in the fuel accumulation chamber 60, 70 suddenly decrease, the pressure from the air in the rear wall interior cavity will move the flexible diaphragm 72 away from the rear wall interior cavity 50 and toward the circular chamber 70 of the fuel delivery ring 38. These movements of the flexible diaphragm 72 modulate the pressure within the fuel accumulation chamber 60, 70, and therefore modulate the pressure leading from the fuel accumulator toward the engine of the vehicle.

The structural configuration of the front wall 14, rear wall 16, and fuel delivery ring 18 are such that these components can be detached from one another and rotated about the central axis 71. For example, FIGS. 2 and 3 show the fuel delivery ring oriented with its outlet ports 40 and 42 facing away from inlet port 44, whereas FIG. 4 shows the outlet ports 40 and 42 facing laterally with respect to inlet port 44. This permits the engineer or mechanic that is installing or maintaining the fuel accumulator to orient the fuel delivery ring 38 so that its outlet ports 40 and 42 face in a desired direction for connection to fuel lines.

It will be noted that the sight glass 26 will always be aligned with the filter 76 for the purpose of visually inspecting the surface of the filter that faces the unfiltered fuel chamber 60.

Although preferred embodiments of the invention has been disclosed in detail herein, it will be obvious to those skilled in the art that variations and modifications of the disclosed embodiments can be made without departing from the spirit and scope of the invention as set forth in the following claims.

I claim:

1. A fuel pressure accumulator for an internal combustion engine comprising:

a segmented housing including a front wall defining a front wall internal cavity, a rear wall defining a rear wall internal cavity, said front wall internal cavity and said rear wall internal cavity facing each other, and a fuel delivery ring positioned between said front and rear walls and forming with the front wall internal cavity and said rear wall internal cavity a chamber, a flexible diaphragm positioned between said rear wall internal cavity and said fuel delivery ring and defining a gas chamber adjacent said rear wall and a fuel accumulation chamber adjacent said front wall internal cavity and said fuel delivery ring, a filter positioned between said front wall and said fuel delivery ring, and a fuel communication port positioned in said front wall and a fuel communication port positioned in said fuel delivery ring, so that fuel enters one of the fuel communication ports, passes through the filter and out of the other fuel communication port, and the flexible diaphragm flexes in response to the change in pressure of the fuel in said fuel accumulation chamber.

2. The fuel pressure accumulator of claim 1, and further including a sight glass assembly positioned in said front wall for viewing said filter.

3. The fuel pressure accumulator of claim 1, wherein said fuel delivery ring and front wall are configured so that said fuel delivery ring is repositionable with respect to said front wall to reorient the fuel communication port of the front wall with respect to the fuel communication port of the front wall.

4. A fuel pressure accumulator and filter for an internal combustion engine comprising:

a segmented housing including a front wall defining an inner cavity, and a rear wall defining an inner cavity, said front wall inner cavity facing said rear wall inner cavity, a fuel delivery ring positioned between said front and rear walls, said fuel delivery ring having opposed ends mounted to said front wall and said rear wall, and forming with the front wall inner cavity and the rear wall inner cavity a chamber, a flexible diaphragm positioned between said rear wall and said fuel delivery ring and extending across said chamber, said rear wall and said flexible diaphragm defining a gas chamber adjacent said rear wall, said front wall, said fuel delivery ring and said flexible diaphragm defining a fuel accumulation chamber adjacent said front wall and said fuel delivery ring, a fuel communication port positioned in said front wall, a fuel communication port positioned in said fuel delivery ring, a filter positioned between said front wall and said fuel delivery ring dividing said fuel accumulation chamber into a filtered fuel chamber at said fuel delivery ring and an unfiltered fuel chamber at said front wall, so that fuel entering one of the fuel communication ports moves through the filter and out of the other fuel communication port, and changes in pressure of the fuel move the diaphragm.

5. The fuel pressure accumulator and filter of claim 4, and further including:

connector means rotatably connecting said fuel delivery ring to said front wall, so that said fuel delivery ring can be rotated with respect to said front wall for re-orienting the fuel communication port of said front wall with the fuel communication port of said fuel delivery ring.

6. The fuel pressure accumulator and filter of claim 5, and further including a sight glass assembly positioned in said front wall for viewing said filter.

7. The fuel pressure accumulator and filter of claim 4, wherein said fuel communication port in said delivery ring comprises a plurality of fuel communication ports.

8. A fuel pressure accumulator and filter for an internal combustion engine comprising:

a segmented housing including a front wall defining an internal cavity and a rear wall defining an internal cavity, with said cavities facing each other and forming a chamber, a flexible diaphragm positioned between said front wall and said rear wall and across the chamber and defining with said rear wall a pressure responsive gas chamber and defining with said front wall a fuel accumulation chamber, a fuel filter positioned between said front wall and said flexible diaphragm, a fuel inlet port defined in said front wall and a fuel outlet port defined between said flexible diaphragm and said filter, so that fuel enters through the fuel inlet port on one side of the filter, passes through the filter and then exits through the outlet port, and the flexible diaphragm moves in response to the changes in pressure of the fuel in the chamber.

9. The fuel pressure accumulator and filter of claim 8, and further including a sight glass extending through said front wall for viewing the filter from outside the front wall.

10. The fuel pressure accumulator and filter of claim 8, wherein said front and rear walls are configured to be repositioned with respect to each other.

11. The fuel pressure accumulator and filter of claim 8, wherein a fuel delivery ring is positioned between said front wall and said rear wall and wherein said fuel outlet port is positioned in said fuel delivery ring.

12. The fuel pressure accumulator and filter of claim 11, and wherein said fuel delivery ring is configured to be rotatable with respect to said front wall for changing the relative positions of the inlet port and the outlet port.

13. A fuel pressure accumulator and filter for an internal combustion engine comprising:

a segmented housing including first and second housing segments, said housing segments defining a chamber, a flexible diaphragm extending across said chamber and defining with said second housing segment a gas chamber and defining with said first housing segment a fuel accumulation chamber, a fuel filter positioned in and extending across said fuel accumulation chamber and defining on one side thereof an unfiltered fuel accumulation chamber and defining on the other side thereof a filtered fuel accumulation chamber, a fuel inlet port in communication with said unfiltered fuel accumulation chamber, at least one fuel outlet port in communication with said filtered fuel accumulation chamber, means for changing the position of said fuel outlet port with respect to said fuel inlet port for directing the fuel in different directions from said segmented housing, so that fuel enters through the fuel inlet port on one side of the filter, passes through the filter and then exits from the other side of the filter through the outlet port, and the flexible diaphragm moves in response to the changes in pressure of the fuel in the fuel accumulation chamber.

14. The fuel pressure accumulator and filter of claim 13, wherein said at least one fuel outlet port comprises a plurality of fuel outlet ports each extending in different directions.

15. The fuel pressure accumulator and filter of claim 14, and further including a sight glass positioned in said first housing segment aligned with said filter for observing the condition of said filter.

16. The fuel pressure accumulator and filter of claim 13, and further including a fuel delivery ring positioned between said first housing segment and said second housing segment, said fuel outlet port being formed in said fuel delivery ring, said filter positioned between said fuel delivery ring and said first housing segment, and said flexible diaphragm positioned between said fuel delivery ring and said second housing segment, and connector means configured for connecting said fuel delivery ring to said first housing segment at different orientations for adjusting the position of the fuel delivery port with respect to the fuel inlet port.

17. A method of controlling changes in pressure of fuel and filtering fuel moving from a fuel tank of an automobile to the engine of the automobile, comprising:

moving fuel from the fuel tank through an inlet port into an accumulation chamber, moving the fuel through a filter in the accumulation chamber to filter the fuel and then into engagement with a flexible diaphragm facing the accumulation chamber, moving the filtered fuel radially out of said accumulation chamber through a fuel outlet port to the engine, and moving the diaphragm with the filtered fuel in response to the changes in pressure of the fuel in the fuel accumulation chamber.

18. The method of claim 17, and further including adjusting the position of the outlet port with respect to said inlet port for directing filtered fuel to the engine.

* * * * *